United States Patent [19]

Cowen

[11] Patent Number: 4,691,976

[45] Date of Patent: Sep. 8, 1987

[54] COAXIAL CABLE TAP CONNECTOR

[75] Inventor: Judith A. Cowen, Palo Alto, Calif.

[73] Assignee: LRC Electronics, Inc., Horseheads, N.Y.

[21] Appl. No.: 831,007

[22] Filed: Feb. 19, 1986

[51] Int. Cl.[4] ..... H01R 4/02

[52] U.S. Cl. ..... 439/394; 29/828; 29/748; 439/582

[58] Field of Search ..... 339/177 R, 177 E, 97 R, 339/97 P, 99 R; 29/828, 748, 564.2; 408/113, 114, 97, 115 R; 269/87.3, 152, 903

[56] References Cited

U.S. PATENT DOCUMENTS 4,210,378 7/1980 Baribeau ..... 339/97 R
4,469,391 9/1984 Rich ..... 339/97 R

FOREIGN PATENT DOCUMENTS 0121958 10/1984 United Kingdom ..... 339/97 R

*Primary Examiner*—Gil Weidenfeld
*Assistant Examiner*—David Pirlot
*Attorney, Agent, or Firm*—Weingarten, Schurgin, Gagnebin & Hayes

[57] ABSTRACT

A connector to provide a coaxial cable tap without shorting the conductors and without significantly changing the coaxial cable parameters which would affect the data flow therein. The apparatus of the present invention can therefore be attached to the cable while the cable continues to pass signals. The connector itself provides a guide for a cutting operation and for the subsequent assembly of the finished connector. The cable tap mounts perpendicular to the coaxial cable, and includes a center pin which attaches to the coaxial cable center wire along the axis of the cable tap. The center pin has two prongs spaced apart in opposition to straddle and securely retain the center conductor. The assembled connector provides a top having a standard connector, such as an "F" or "BNC" connector. The resulting cable connection has a long and reliable life, installed without causing an interruption to information or signal flow on the cable at any time.

7 Claims, 5 Drawing Figures

COAXIAL CABLE TAP CONNECTOR

FIELD OF THE INVENTION

The present invention relates to electrical cable connectors, and in particular coaxial cable "T" connectors.

BACKGROUND OF THE INVENTION

Cable tap connections to coaxial cables for RF signals and computer data information traditionally have been provided by splicing into the cable. One way of providing splicing is to cut the cable and affix a male connector on each end of the severed cable. A terminal block having three parallel female connections, is used to connect the two spliced ends and to provide the additional cable tap signal path. Not only does this interrupt the signal path, causing an interruption in the data or signal transfer service, but also requires expensive machined connector parts, and careful assembly by skilled technicians. Moreover, if this connector is to be used in the external environment, each of those connectors requires a particular method of weatherproofing.

A second approach commonly used in the data network style coaxial connections is to clamp the cable in a fixture having two jaws, thus securing the cable therebetween. One of the two jaws has a threaded opening to receive a conical cable piercing signal probe along an axis perpendicular to the cable. The signal probe is then screwed into the cable to first displace the outer shield. The tip then proceeds through the dielectric of the cable until it comes in contact with the cable center conductor. However, since the probe provides a unilateral pressure on the center conductor of the cable, the pressure between the probe tip and the center conductor decreases with time due to material relaxation. Moreover, if the tap is not carefully applied, or if the cable suffers from variations in the alignment of the elements, such as the placement of the center wire, a signal probe will not properly contact the center cable. Additionally, while the probe tip is piercing the outer conductive shield, portions of it may be pulled through the dielectric, shorting out the center conductor. This short circuit condition, which may be temporary, can nonetheless cause a critical and serious disruption of service.

Another cable connector includes a second cable-piercing probe in contact with the center conductor and disposed in opposition to the signal probe. The additional probe may be spring-loaded to provide a constant force on the center conductor, and therefore a constant force between the center conductor and the signal probe. However, this too introduces a possibility of another temporary short circuit-condition during installation, and critically relies on the accuracy of the position of the cable center conductor. Moreover, the application of each cable-piercing pin presents a capacitive load to the cable of at least five picofarads, which may place an undesired load on the cable.

Drilling fixtures have also been suggested to reduce the additional capacitance or the likelihood of short circuits. However, since the axis of the drill is aligned perpendicular to the center wire so that the signal pins coincide therewith, the depths by which the cable is drilled, and location of the cable drill is critical, and must be carefully measured and controlled.

BRIEF DESCRIPTION OF THE INVENTION

The cable tap connection comprises a two-piece structure which is clamped to the cable. Connection to the cable center conductor is first prepared by removal of a predetermined portion of the coaxial cable outer shield and dielectric material, without contact to the center conductor, using the connector body itself as a cutting fixture. The connector of the present invention includes a self-aligning screw-in center tip formed to securely engage the coaxial cable center conductor along an axis perpendicular to the axis of the coaxial cable, after the portion of the shield and dielectric material is removed. After the cutting and center conductor assembly operation, the cable tap is ready for use. Tight tolerances and accuracy are achieved and maintained through the assembly process by the use of a connector structure which includes a cable cutting guide located within the upper portion of the connector which receives a cutting tool. In this manner, each cutting operation is performed with the same support structure as the finished connector, whose tolerances are therefore of less concern, since each step is a final step, which results in a high-accuracy and secure connector.

The apparatus of the present invention provides a relatively inexpensive cable connector providing a quick and reliable connection which does not interrupt the signal flow in the cable to which the tap is affixed. Moreover, the cable connector may be applied by untrained personnel, who are not required to make any measurements or perform any complex procedures. Furthermore, the present invention is tolerant to cable manufacturing irregularities, and maintains constant characteristics over an extended life span.

BRIEF DESCRIPTION OF THE DRAWING

These and other features of the present invention will be better understood from the following detailed description, taken together with the drawing, wherein.

DETAILED DESCRIPTION OF THE INVENTION

Figure 1:
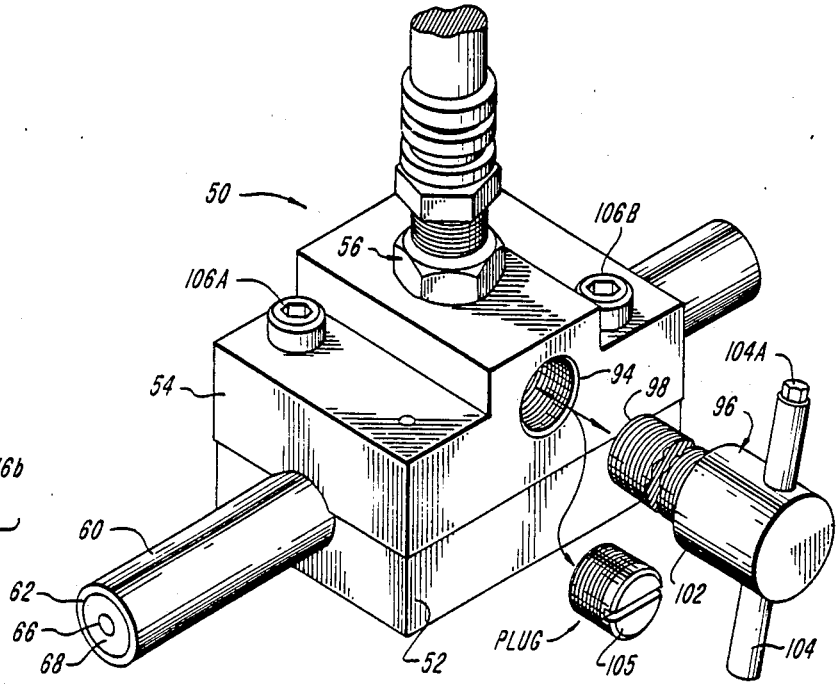
FIG. 1 is a perspective of the connector of the pin installed on a coaxial cable.
Figure 3:
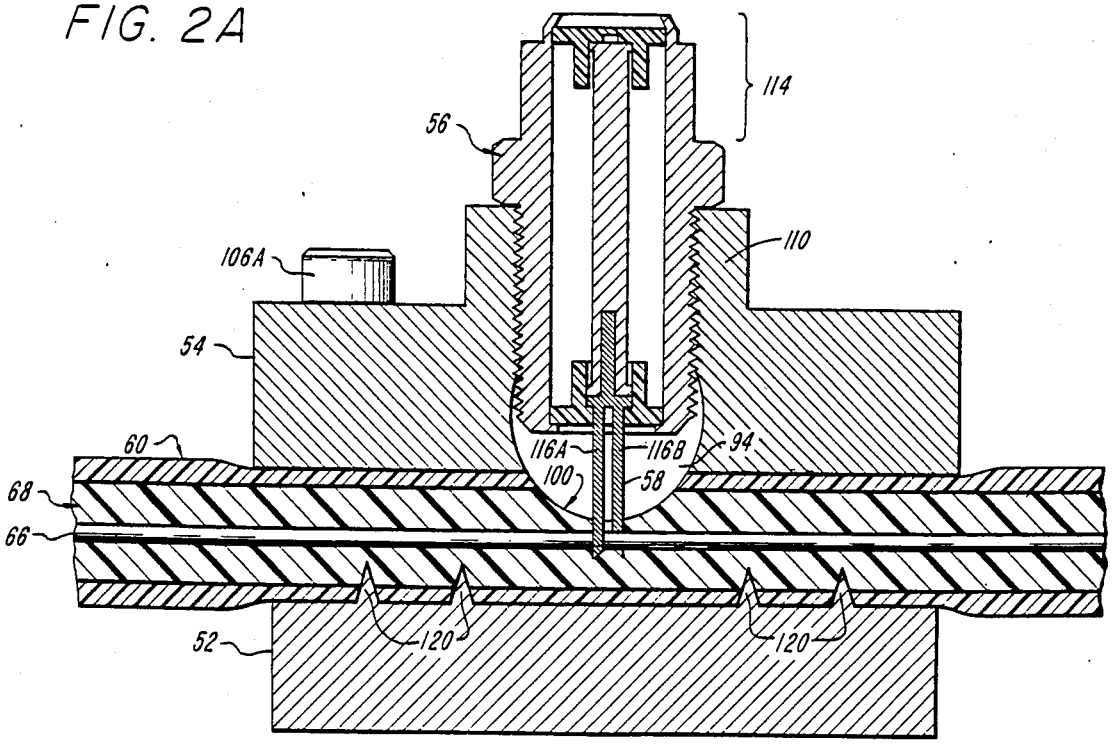
FIG. 3 is a section through the connector of FIG. 1, showing the cable connector interacting with the cable.
Figure 4:
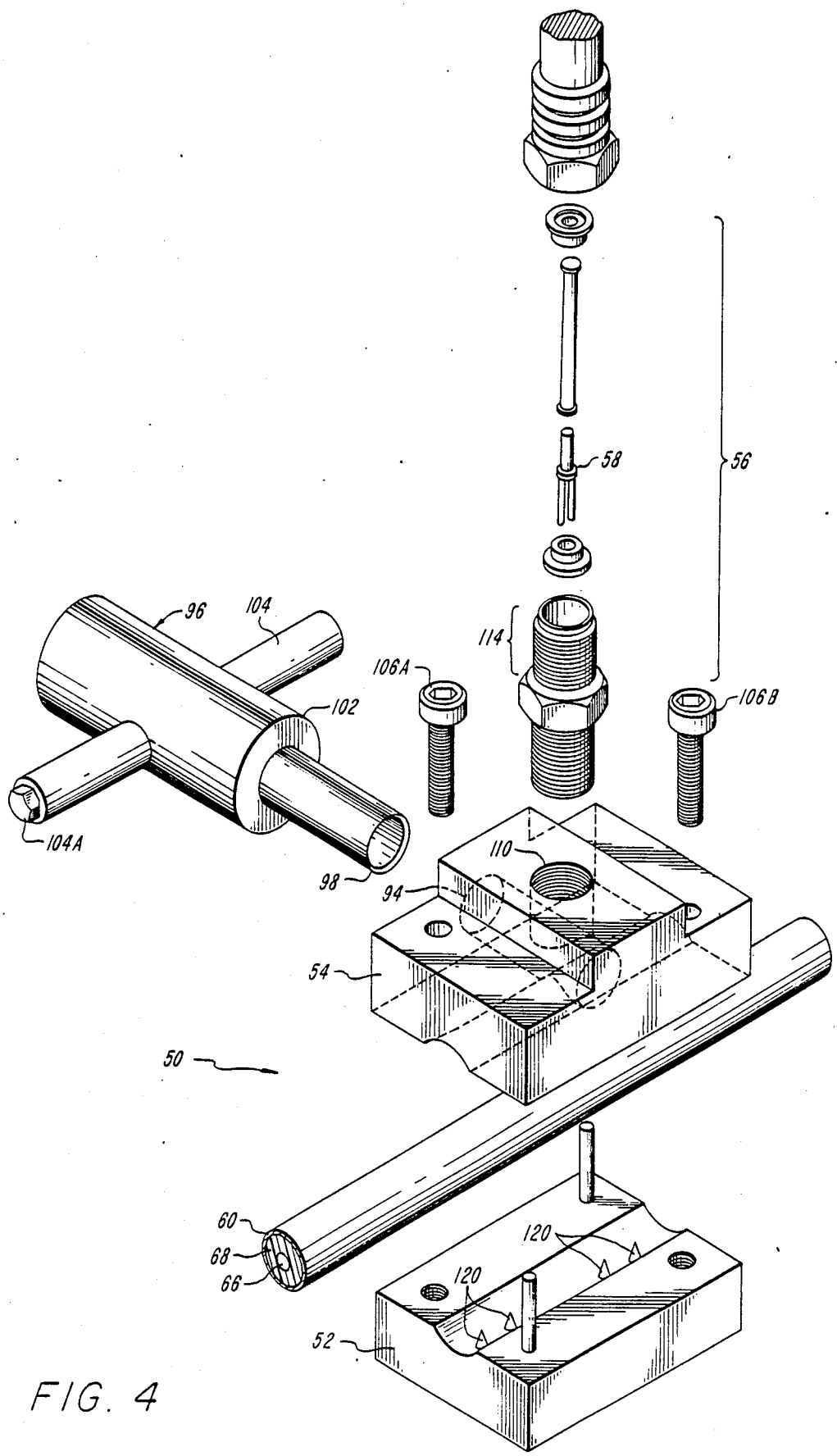
FIG. 4 is an exploded view of the connector.

A perspective cut-away of the connector 50 of the present invention is shown in FIG. 1, and an exploded view is shown in FIG. 4, which includes a bottom piece 52, a top 54, and a screw-in coaxial cable connector 56 received by the top piece 54. The coaxial cable connector 50 is electrically and mechanically secured to a coaxial cable 60. The coaxial cable 60 includes a center conductor 66, an outer concentric shield 62, a cable dielectric insulator 68, and a protective outer coating 64. The screw-in coaxial cable connector 56 includes a center contact 58 (of FIGS. 2A, 2B, 3, and 4) to connect mechanically and electrically to the center conductor 66 within the body of the connector 50, described below in detail.

It is the intent of the present invention that the cable may be maintained in service while the cable preparation is in progress, as well as while the subsequent cable connector components are affixed. According to the present invention, the center pin 58 of the screw-in cable connector 56 engages the center conductor 60 without shorting to the shield 62 of the cable 60. In order to provide this feature, the cable is prepared by selectively removing a portion of the cable shield 62 and a limited portion of the dielectric 68.

The fixture necessary to provide such preparation is inherent in the upper portion of the top piece 54. The base plate 52 and top piece 54 retain the cable 60 therebetween. The upper piece 54 of the connector 50 is positioned above the lower piece 52, while the cable 60 is retained within the connector 50 by screw fasteners 106A and 106B, or other means, as desired. The lower piece 52 also contains cable cover 64 piercing pins 120 in order to secure electrical and mechanical connection between the shield 62 and the lower piece 52. The curved surfaces in the top and bottom pieces which form an opening to hold the cable form an elliptical opening (having a lesser distance between the pieces than across each recess) to provide an imporved mechanical grip. The fasteners 106A and 106B are advanced until the pieces 52 and 54 are securely clamped to the coaxial cable 60. An opening 94, perpendicular to the axis of the cable 60, receives a cutting tool 96, discussed further below. The axis of the opening 94, laterally displaced from the axis of the cable 60, allows the front surface 98 of the cutting tool 96 to tangentially engage the cable 60, selectively removing the portion thereof. The cutting surface 98 of the cutter 96 comprises a concave interior section with a sharpened exterior cutting surface. The cutting tool 96 has a raised outer shoulder portion 102 to limit the extension into the cutting block 90 during operations. A perpendicular handle 104 having an allen-wrench form on one end 104A, which mates with screw fasteners 106A and 106B, is provided for operator ease of use, and other handle means are possible as desired. Appreciating that the concentric shield 62 of the cable 60 is typically composed of either a metal foil or a wire braid, and that either may easily stretch or fragmentize during splicing operations, short circuits are prevented in the present invention wherein the cutting surface 98 cuts through the coaxial cable without exposing the center conductor 66 as shown in FIG. 3. In a subsequent step, the coaxial cable connector 56 connects to the center conductor 66 of the cable 60 through the dielectric 68. The axis of the opening 94 (and the cutting tool 96) is laterally displaced from the axis of the coaxial cable 60 as retained between the base plate 52 and the top piece 54 so as not to permit the cutting edge 98 or any portion of the cutting tool 96 to come in contact with the center conductor 66 of the coaxial cable 60 during cutting operation. It can be appreciated that until the connector 56 is applied, the dielectric 68 is smooth and without opening, providing easy preassembly inspection, if desired. According to this particular embodiment of the present invention, the cutting tool 96 and the cutting surface 98 as well as the opening 94 are circular.

After the cable is cut, the cutter 96 is shown withdrawn, having provided the desired concave cut 100, shown in FIG. 3, in the coaxial cable 60. It is noted that the cut 100 (before the connector 56 is attached) through the dielectric 68 without exposing the center conductor 66 in the area of the cut 100. A plug 105 is inserted in the opening 94 to provide a closed, sealed connector 50.

The upper piece 54 of the connector 50 includes a threaded opening at 110 to receive the threaded conector piece 56 having a complementary set of threads. The connector 56 also includes a cable mating connector end 114 having screw, BNC, or other style common to the data and RF technologies as desired. The threaded cable connector 56 is screwed into the threaded opening 110 of the upper piece 54 until completely seated. While the connector 56 is screwed into the connector opening at 110, the center pin 58, having two laterally opposed surfaces 116A and 116B (shown in FIGS. 2A and 2B), enters the coaxial cable 60 through the opening cut 100 and displaces the dielectric materials 68 to come in contact with and to electrically and mechanically secure connection with the center conductor 66, as discussed below. According to the feature of the present invention, the connector 56 may be inserted without measurement or adjustment, since the dual tips 116A and 116B of the center pin 58 are self-aligning during the assembly process.

Figure 2B:
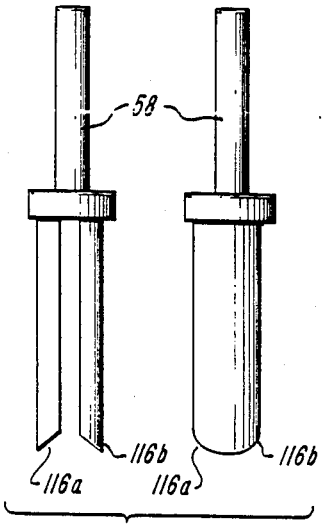
FIG. 2B is a second view of the connector center pin.
Figure 2A:
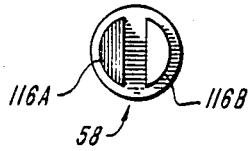
FIG. 2A is an end and a side view of the connector center pin.

The center pin 58 is shown in FIGS. 2A and 2B, wherein the laterally opposing pins or tips 116A and 116B can be seen in detail. The tips 116A and 116B include edges in opposition across the diameter at the wire to provide the desired mechanical and electrical connection thereto. More particularly, the criterion for proper operating tips 116A and 116B of pin 58, are that the tips 116A and 116B exert a spring force on the center conductor 66 material to insure contact.

A detailed perspective cutaway of the cable connector 56 engaging the coaxial cable 60 is shown in FIG. 3, and an exploded view is shown in FIG. 4. As shown in FIG. 3, the two tips 116A and 116B extend through the dielectric material 68 to partially surround and retain the center wire 66 in secure electrical and mechanical contact. By application of laterally opposing connector tips 116A and 116B, connection to the center conductor 66 is made without placing unilateral stresses thereon, which may relax or otherwise change through time. Furthermore, the distance between the laterally opposing contacts 116A and 116B is slightly smaller (by 0.003 inch typically) than the diameter of the center conductor 66. Also shown in FIG. 3 are four shield-piercing pins or spikes 120. Four pins are selected; however, more or fewer may be used. The piercing pins 120 provide firm electrical and mechanical connections to the shield 62 of the cable 60 when the lower connector piece 52 and the upper piece 54 of the connector 50 are attached as described above.

The present invention is not limited by the above solely exemplary detailed description. Modifications and substitutions by those skilled in the art are considered within the scope of the present invention. Therefore, the present invention is not to be considered limited except by the following claims.

What is claimed is:

1. A connector tap for a coaxial cable having a center conductor, a dielectric material surrounding said center conductor, and a shield concentric to said dielectric material, comprising:

a top piece partially surrounding said coaxial cable having a first aperture orthogonal to and offset from the axis of said coaxial cable and a second aperture having an axis normal to and intersecting the axis of said coaxial cable disposed orthogonal to said first aperture;

a bottom piece maintained integrally with said top piece and partially surrounding said coaxial cable;

means for forming a conductive path between said concentric shield and at least one of said top piece and said bottom piece; and a center contact pin further including axially extending laterally-displaceable parallel pins passing through said second aperture to mechanically and electrically engage said center conductor of the coaxial cable at two surfaces thereof, wherein said bottom piece and said top piece are integrally maintained as selected portions of said concentric shield and said dielectric material are removed through said first aperture and said center contact pin is inserted through said second aperture to displace some of the unremoved portion of said dielectric material and mechanically and electrically engage said center conductor at two surfaces thereof.

2. The connector of claim 1 further including plug means insertable in said first aperture for closing and securing said connector tap.

3. The connector of claim 1 wherein said center contact pin is inserted through said second aperture of said top piece by screwing means.

4. The connector of claim 3, wherein said axial extending laterally-displaceable parallel pins comprise two pins each having a sector cross-section wherein the apex of each said sector is spaced apart to mechanically and electrically engage the center conductor at two surfaces thereof.

5. The connector of claim 3, wherein said contact pin is self-aligning to mechanically and electrically secure contact to the coaxial cable center conductor.

6. The connector of claim 3, wherein said aperture is cylindrical.

7. A method of providing a tap to a coaxial cable having a center conductor, a shield conductor, and a dielectric layer therebetween, comprising the steps of:

securing said cable to a connector housing including a top piece and a bottom piece for cable support, said connector housing being maintained as an integral unit during subsequent steps for providing said tap to said coaxial cable;

providing a cutting path orthogonal to and offset from the axis of said coaxial cable through said connector top piece;

selectively removing a portion of the coaxial cable shield conductor and the dielectric layer without contacting said center conductor;

closing said cutting path to securely close said connector housing; and inserting a center conductor pin to provide contact with two surfaces of said center conductor through said connector top piece.

* * * * *